US005784816A

United States Patent [19]

Zapawa

[11] Patent Number: 5,784,816

[45] Date of Patent: Jul. 28, 1998

[54] PROTECTIVE TICKET HOLDER AND MEMORABILIA DEVICE

[76] Inventor: Timothy J. Zapawa, 5951 Lodewyck St., Detroit, Mich. 48224-1311

[21] Appl. No.: 653,175

[22] Filed: May 24, 1996

[51] Int. Cl.[6] ..... G09F 3/18

[52] U.S. Cl. ..... 40/654.01; 40/661.08; 40/1.6; 283/109

[58] Field of Search ..... 40/1.5, 1.6, 124.06, 40/654.01, 661, 661.08, 661.09, 776; 283/77, 106, 107, 109, 112, 900; 150/145, 147

[56] References Cited

U.S. PATENT DOCUMENTS

| | | | |
|---|---|---|---|
| 193,382 | 7/1877 | Pinney et al. . | |
| 513,749 | 1/1894 | Atherton . | |
| 954,336 | 4/1910 | Patton . | |
| 1,466,729 | 8/1923 | Riley . | |
| 1,666,006 | 8/1928 | Duncan . | |
| 1,690,083 | 10/1928 | Waterman . | |
| 2,725,913 | 4/1955 | Horwin . | |
| 3,216,135 | 11/1965 | Wright . | |
| 3,295,235 | 1/1967 | Tauber . | |
| 3,350,799 | 11/1967 | Japs . | |
| 3,464,135 | 9/1969 | Eidinger | 40/661 X |
| 3,657,834 | 4/1972 | Tauber . | |
| 4,259,797 | 4/1981 | Belser . | |
| 4,435,912 | 3/1984 | Adrian et al. | 40/626 X |
| 4,509,277 | 4/1985 | Bolton | 40/1.5 |
| 4,722,376 | 2/1988 | Rhyner | 40/1.5 X |
| 5,000,319 | 3/1991 | Mermelstein | 40/776 X |
| 5,090,732 | 2/1992 | Kuhns et al. . | |
| 5,380,046 | 1/1995 | Stephens | 283/107 X |
| 5,388,739 | 2/1995 | Gargan . | |
| 5,461,810 | 10/1995 | Goserud . | |

*Primary Examiner*—Brian K. Green
*Attorney, Agent, or Firm*—Rader Fishman & Grauer PLLC

[57] ABSTRACT

A ticket holder adapted to be worn by a patron comprising a generally rectangular transparent laminated memorabilia card, with the card including aligned rear and front panels with a common outer periphery. An insert displaying information is disposed between the rear panel and the front panel such that the insert is spaced away from the outer periphery, and the rear panel is bonded to the front panel along the outer periphery. The ticket holder includes a transparent ticket pocket including aligned rear and front partitions in facing relation to one another and bonded to the front panel of the card.

15 Claims, 3 Drawing Sheets

PROTECTIVE TICKET HOLDER AND MEMORABILIA DEVICE

FIELD OF THE INVENTION

The present invention relates to a ticket holder and more particularly to a protective ticket holder secured to at least one laminated card capable of displaying additional information.

BACKGROUND OF THE INVENTION

When attending entertainment events such as concerts, sporting events, fairs, plays, and the like, or when commuting, ticket stubs must usually be retained by a patron. The ticket stubs are typically used to ensure proper seating and to show authorization to be present in a specific location at a particular time.

Unfortunately, however, ticket stubs are often lost or misplaced, resulting in problems for security personnel, ushers, or conductors, and embarrassment and grief for the patron. Further, particularly when attending entertainment events, a patron may want to retain the ticket stub as a souvenir of the event attended. Yet, even if not lost, ticket stubs are often damaged through normal usage at the event, with bent corners, scuffs, crumpling or tears. Thus, the sentimental and possible monetary value of the ticket stub as a souvenir is reduced for the patron. Even when patrons have properly saved the ticket stubs, the patrons often have their hands filled with food and beverages, articles of clothing or other items making it very inconvenient for them to search for, retrieve and display their ticket stubs to authorized personnel upon request.

Additionally, ticket issuers, as well as patrons, often encounter clever forgeries of tickets, leading to troubling situations where patrons desiring to attend entertainment events are deceived by unscrupulous counterfeiters and where patrons are prevented from attendance. Such ticket issuers also may wish to limit access to some areas to only particular classes of attendees, as, for example, limiting attendance in student sections to students only. Frequently, the ticket issuers may be forced to expend additional money on personnel or security devices to prevent any fraudulent compromise of the ticket from occurring. Ticket issuers may include, for example, the use of sophisticated holograms on the ticket itself, or even require that picture identification be presented with the ticket to permit entry into the event. Such precautions become expensive for the issuer and inconvenient for the patron, especially in multi-event seasons such as sporting seasons. Other patrons, particularly season ticket holders, often desire to keep in a single safe location their season parking pass, only one of which is usually issued, which must be presented along with the ticket for the particular event when parking.

Additionally, patrons desire a safe place in which to conceal and protect small items like identification cards, money, or the like. At some events, patrons would rather not carry a purse or a wallet due to fear of loss or theft, as well as due to the inconvenience of carrying and safeguarding such an item. However, the patron may not have sufficient pockets available within which to carry items such as cash, credit cards, identification, parking passes, or the like.

Further, in addition to the ticket stubs, many patrons of entertainment events often desire a displayable souvenir bearing a team logo, band picture, or the like. The merchandising of collectible memorabilia has become a big business at entertainment events around the world. Many items sold as collectible memorabilia are often articles of clothing such as caps, shirts and coats. Other items include mugs, key chains and pictures, but such items are not as readily displayable, particularly when attending the event itself.

Various types of transparent holders are known in the prior art. They generally pertain to the retention and display of convention badges, identification cards, commuter tickets and the like. However, many of the holders require a pocket to use the device. Others require the use of pins or other clothing attachment which may damage clothing or the device. The prior art includes a badge with a means for retaining the badge on an article of clothing and a ticket with a pressure sensitive adhesive on the stub portion so that it may be attached to clothing. However, either the badge or ticket stub or the clothing may be damaged when removed. Further, only one side of such a device is able to be seen at any time, and that side does not allow for the display of information other than the ticket or badge itself.

Additionally, one of the holders known to the inventor includes a plastic envelope that is secured to a neck band. The envelope may hold a ticket. The device is designed such that the front of the envelope will always lie flat with only the front of the ticket viewable at all times. Thus, the invention teaches the importance of displaying only a single side of the holder. Further, while a small self-adhesive advertising sticker may be affixed to the holder, the sticker is not intended to be prominent. Nor is it protected from damage. Additionally, the sticker lacks aesthetic value, as well as any sentimental or actual value to the ticket-holder.

SUMMARY OF THE INVENTION

An inventive protective ticket holder and memorabilia device is disclosed wherein a protective ticket holder is secured to a laminated card capable of displaying additional information, the combination adapted to being conspicuously worn to display both a ticket and the card. The card may include such things as a team logo, a parking pass, or a security device while allowing easy access to the ticket received in the ticket holder. Thus, the information displayed on the card may have use independent of the ticket itself, or may be an authentication device for the ticket. A second embodiment of the invention includes two laminated cards, each displaying additional information wherein the two cards are configured to conceal a pocket to further allow the patron to safeguard items therewithin. The protective ticket holder is secured to the front face of one of the laminated cards. A third embodiment of the invention is manufactured from a single elongated sheet of transparent plastic material which is folded along an odd number of fold lines. An insert may be sealed within the folds to display information. A protective ticket holder constructed from a single rectangular piece of transparent material is bonded along three of its borders to the outside face of the sheet with a transparent pressure sensitive adhesive.

More specifically, a first embodiment of the invention includes a generally rectangular transparent laminated card, with the card including aligned rear and front panels with a common outer periphery, an insert disposed between the rear panel and the front panel with information printed on at least a portion of the insert which is in facing contact with the rear panel. The insert is spaced away from the outer periphery, and the rear panel is bonded to the front panel along the outer periphery. An aperture is formed along a portion of the outer periphery. Further, a generally rectangular transparent ticket pocket is bonded to the card. The ticket pocket includes aligned rear and front partitions in facing relation to one another which are sealed along three sides with the pocket open along a fourth side. The ticket pocket is smaller than the card.

In a second embodiment, a protective ticket holder is disclosed which includes a second transparent laminated card with its own insert. The second card is positioned in a facing relationship with the first card, whereby the front panel of the second card is placed against the rear panel of the first card. The first card is bonded to the second card along three sides in such a way as to create a concealed pocket between the two cards. Thus, the insert of the first card typically displays information which is in facing contact with its front panel, while the insert of the second card typically displays information which is in facing contact with its rear panel. It may be desirable to print information upon the portion of the insert of the first card which is in facing contact with its rear panel and upon the portion of the insert of the second card which is in facing contact with its front panel. In this way, information is hidden with the concealed pocket which is revealed when the pocket is opened. In this embodiment, the top portion of the first card is dimensioned longer than the top portion of the second card, and an aperture formed along the longer top portion of the first card. Finally, a generally rectangular transparent ticket pocket is included which is bonded to the front panel of the first card. The ticket pocket has aligned rear and front partitions in facing relation to one another which are sealed along three sides with the pocket open along a fourth side. The ticket pocket is smaller than the cards.

In a third embodiment, a protective ticket holder and method for making it are disclosed. The holder comprises a single sheet of flexible plastic material formed into a generally rectangular or otherwise elongated shape. An odd number of fold lines are made in the sheet in a direction perpendicular to the longest side of the sheet. In this way, the sheet is divided into an even number of panels. The fold lines alternate in opposite directions to provide the sheet with an accordion-like shape. A printed insert is placed between the accordion-shaped panels such that the printed matter is visible through at least one outermost panel. The assembly is then sealed along the three edges of the outermost panels which do not include a fold line. In this way, a concealed pocket to safeguard items therewithin is formed between the outermost panels, with the pocket opening defined by the fold lines of the outermost panels. A ticket pocket made from a single rectangular piece of transparent material may be bonded to the external face of one of the outermost panels with a pressure sensitive adhesive applied to three borders of the ticket pocket.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
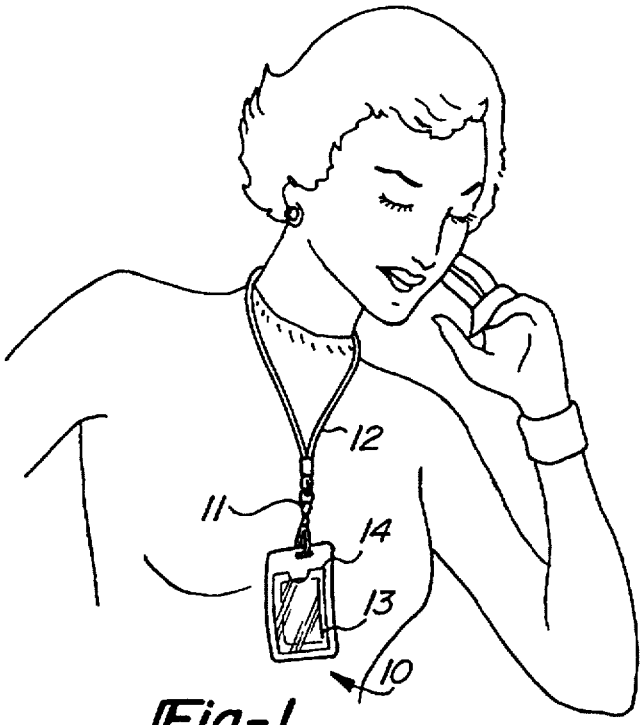
FIG. 1 is a perspective view showing the invention in use around the neck of a patron.

A protective ticket holder 10 is shown in FIG. 1. The holder 10 includes a cord 12, which preferably attaches to the holder by means of a swivel 11. A ticket 13 is received within a front pocket 14, which is fabricated from at least one panel of transparent plastic material.

Figure 3:
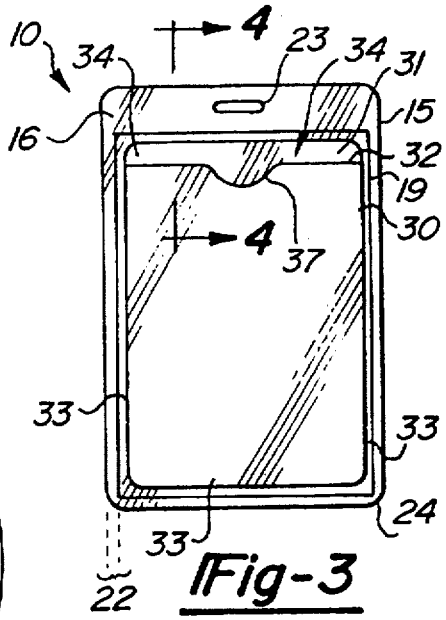
FIG. 3 is a front view of the first embodiment.
Figure 2:
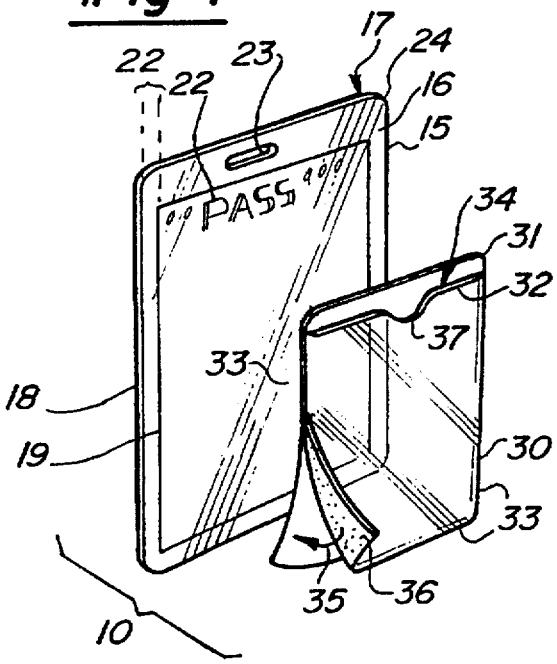
FIG. 2 is an exploded perspective view of a first embodiment of the invention.
Figure 4:
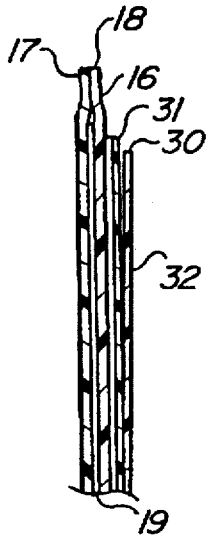
FIG. 4 is a fragmentary cross-sectional view taken along arrows 4—4 of FIG. 3.

As shown in greater detail in FIGS. 2, 3 and 4, ticket holder 10 is provided with a generally rectangular transparent semi-rigid laminated memorabilia card 15 having a front panel 16 and a rear panel 17 with a common outer periphery 18. An insert 19 is disposed between front panel 16 and rear panel 17, having information 21 printed on at least one side of insert 19 in facing contact with a panel of the card. Insert 19 may display team logos or other memorabilia, or else display useful information such as security devices, patron identification, or parking information. A spacing 22 is provided between the outside of insert 19 and outer periphery 18. Bonding of front panel 16 and rear panel 17 along periphery 18 seals insert 19 in place. An aperture 23 is provided generally equidistant between the outer periphery and the outer edge of the insert to releasably engage a means to secure the holder to the patron. Corners 24 of the card are slightly rounded to prevent injury.

A generally rectangular ticket pocket 30 formed of pliable clear plastic includes a rear partition 31 aligned in facing relationship with a front partition 32. Ticket pocket 30 is sealed along three sides 33 and left open along a fourth side 34. Ticket pocket 30 is smaller than card 15, and attached thereto. The front partition 32 of ticket pocket 30 is preferably provided with a thumbnail slot 37 along fourth side 34 to enable easy access to a ticket placed therewithin. Pocket 30 conveniently allows a patron to display a ticket while preventing any undesirable damage to it.

Figure 5:
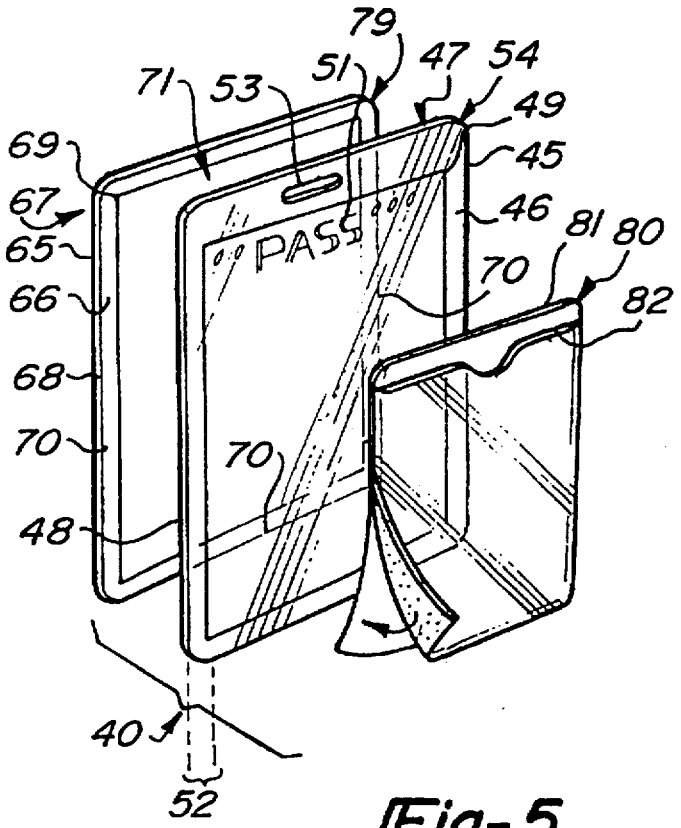
FIG. 5 is an exploded perspective view of a second embodiment of the invention.
Figure 6:
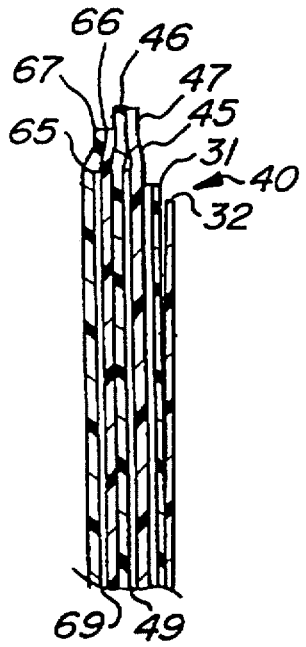
FIG. 6 is a fragmentary cross-sectional view of the second embodiment of the invention.

A second embodiment of the invention is illustrated in FIGS. 5 and 6. The protective ticket holder 40 includes a first generally rectangular transparent memorabilia card 45 having a first front panel 46 and a first rear panel 47 with a first common outer periphery 48. A first insert 49 is disposed between first front panel 46 and first rear panel 47, having information 51 printed on at least the side of insert 49 in facing contact with panel 46. A spacing 52 is provided between the outside of first insert 49 and first outer periphery 48. Bonding of first front panel 46 and first rear panel 47 along periphery 48 seals first insert 49 in place. An aperture 53 is provided generally equidistant between the outer periphery and the outer edge of the first insert to releasably engage a means to secure the holder to the patron. Corners 54 of the card are slightly rounded to prevent injury. Ticket holder 40 additionally includes a second generally rectangular transparent memorabilia card 65 which includes a second front panel 66 and a second rear panel 67 with a second common outer periphery 68. A second insert 69 is disposed between second front panel 66 and second rear panel 67. First card 45 is disposed in facing relationship with second card 65. Second front panel 66 is in facing relationship with first rear panel 47. First card 45 is bonded to second card 65 along three sides 70 to define a pocket 71 therebetween. If first and second inserts 49, 69 are opaque, then pocket 71 is concealed. Pocket 71 is particularly useful for holding valuables, currency or identification, or other items which a patron wishes to safeguard or keep from plain view. The second card has rounded corners 79. As best illustrated in FIGS. 6 and 7, ticket holder 40 includes ticket pocket 30 bonded to front panel 46 in the same manner as discussed above with respect to ticket holder 10.

Figure 7:
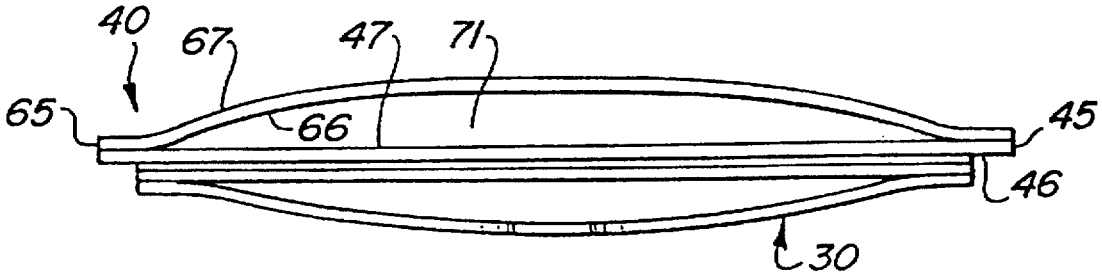
FIG. 7 is a plan view of the second embodiment of the invention.

The advantages of the hidden pocket are further demonstrated in FIG. 7. Ticket pocket 30 is bonded to first front panel 46 of first card 45. Preferably, ticket pocket 30 is formed of transparent material so that printed indicia of interest printed on the first insert is visible when the ticket pocket is empty, or so that a ticket received within the ticket pocket is visible therethrough. Card 65 is bonded to card 45 along three sides forming a hidden pocket 71. Pocket 71 is defined by second front panel 66 and first rear panel 47. Pocket 71 is concealed between first card 45 and second card 65 due to the opaque nature of the inserts disposed within the two cards.

In addition to the advantages of the first embodiment, the second embodiment provides a hidden pocket. The hidden pocket is thereby useful to conceal such things as valuables, currency, identification, or other items the patron wishes to safeguard or keep from plain view.

Figure 8:
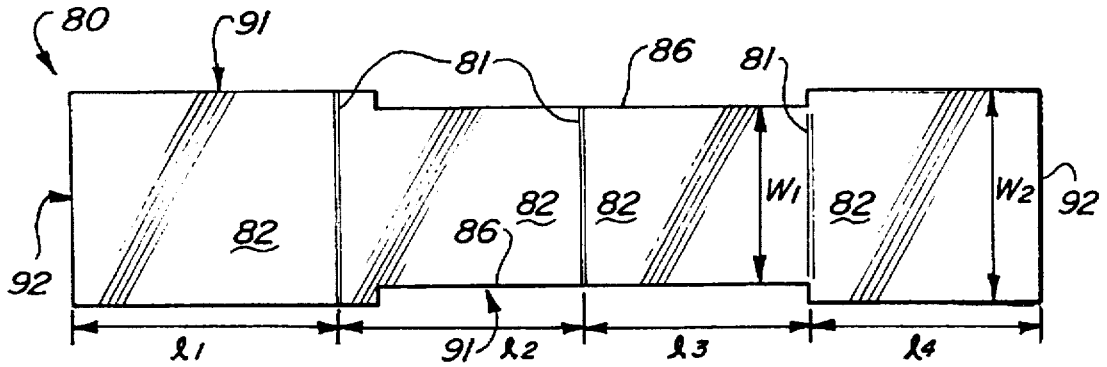
FIG. 8 is a planar view of the third embodiment of the invention.
Figure 9:
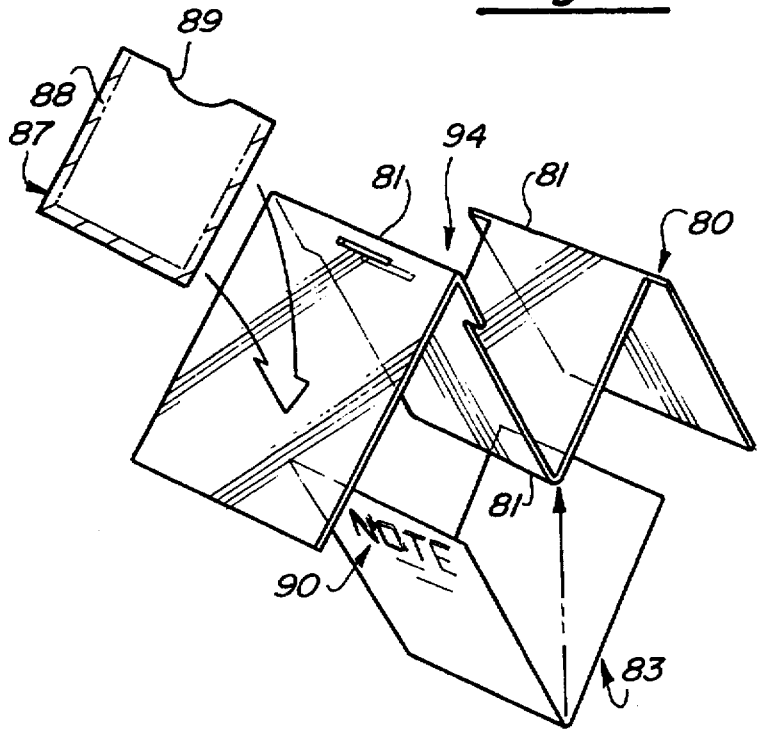
FIG. 9 is an exploded perspective view of the third embodiment of the invention.

A third embodiment and method of constructing the same is depicted in FIGS. 8 and 9. The ticket holder is constructed from a single sheet 80 of flexible transparent plastic material. Sheet 80 preferably has a generally rectangular shape with generally parallel sides 91 longer than adjacent sides 92. An odd number of fold lines 81 are formed in a direction perpendicular to the side 91, thereby creating an even number of panels 82. As best seen in FIG. 9, the fold lines 81 are formed in alternating opposite directions so that the sheet is provided with an accordion-like shape. When folded along fold lines 81, the panels 82 are brought into a superimposed substantially parallel arrangement. A printed insert 83 may be placed within the folds such that printed information 90 is in facing contact with at least the outermost panels of the sheet. The insert is fixed within the sheet by sealing the sheet along the portion of the outer periphery of the outermost panels which does not include fold lines 81. The insert 83 may also be formed from a single sheet of material. The shape of insert 83 may conform to the shape of the sheet 80. Insert 83 may also be folded into an accordion-shape and inserted between multiple panels of the sheet, and may display printed information upon any face in contact with a panel of the sheet.

As shown best in FIG. 8, the sheet may further include a recessed edge 86 substantially along the portion of side 91 lying between the outermost panels. In this way, a width $w_1$ between the recessed edges is less than a width $w_2$ of the outermost panels. Additionally, the length of the panels is adjusted such that lengths $l_1$ and $l_4$ are greater than lengths $l_2$ and $l_3$. When the sheet is folded along fold lines 81 into a superimposed substantially parallel arrangement, only the outside three edges of the outermost panels which do not include fold lines are sealed together. Thus, instead of sealing together all panels, only the two outermost panels need be sealed together to fix the insert within the assembly. The width of insert 83 should not exceed $w_1$ in such an assembly.

Ticket pocket 87 is thereafter attached to an external face of one of the outermost panels. Ticket pocket 87 is made from a single rectangular piece of transparent plastic material and is coated along the border of three sides with a transparent pressure sensitive adhesive 88, with which ticket pocket 87 is attached to the panel. A thumbnail slot 89 is provided along the unsealed fourth side of ticket pocket 87.

With the method disclosed by the third embodiment, the transparent ticket pocket may be readily assembled from a single piece of transparent material. Additionally, the printed insert may be placed easily between a number of adjacent panels and may display information upon any face adjacent to any panel. The recessed edge provides superior bonding because only one seal is created between the two outermost panels, without the interposition of any part of any other panel between the two outermost panels. Additionally, a concealed pocket 94 is formed between the outermost panels, having a top opening defined by a fold line of the shorter of the outermost panels.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A ticket holder adapted to be worn by a patron for conspicuously displaying ticket holder information comprising:

a generally transparent laminated memorabilia card, said card including aligned rear and front panels with a common outer periphery, an insert containing information is disposed between said rear panel and said front panel;

an aperture formed along a portion of said outer periphery; and a ticket pocket for selectively receiving a ticket therein and including at least one ticket panel, said ticket panel dimensioned smaller than said card and being bonded to said front panel of said card;

said ticket pocket overlying a region of said insert and being formed from a generally transparent material for alternately providing visibility of the ticket in said ticket pocket and visibility of the information on said insert region when said ticket pocket is empty; and means for attaching said ticket holder to the patron for conspicuously displaying the ticket holder information wherein said attaching means is at least partially received in said aperture.

2. A ticket holder as recited in claim 1, wherein said attaching means includes a cord adapted to be placed around the neck of the patron, said cord including a securing means adapted to be received in said aperture.

3. A ticket holder as recited in claim 2, wherein said securing means includes a swivel disposed between said cord and said holder such that said holder may be readily rotated between said rear panel displaying said information of said insert and said front panel displaying said ticket.

4. A ticket holder as recited in claim 1, wherein the information is printed on at least a portion of said insert in facing contact with one of said panels.

5. A ticket holder as recited in claim 1, wherein said ticket pocket is formed from a pliable clear plastic and said rear and front panels are formed from a semi-rigid clear plastic.

6. A ticket holder as recited in claim 1, wherein said at least one ticket panel includes aligned rear and front ticket panels in facing relation to one another, and said rear ticket panel includes an optically clear pressure sensitive adhesive in bonding contact with said front panel of said card.

7. A ticket holder as recited in claim 6, wherein said card and said ticket pocket are both generally rectangular, said front and rear ticket panels of said ticket pocket being sealed along three sides with said ticket pocket open along a fourth side.

8. A ticket holder as recited in claim 1, wherein said at least one ticket panel is formed from a pliable clear plastic.

9. A ticket holder as recited in claim 1, wherein said card is formed from a single transparent sheet.

10. A ticket holder as recited in claim 9, wherein said sheet includes a first side with a dimension greater than a second side of said sheet, said sheet formed with an odd number of parallel fold lines, said fold lines perpendicular to said first side of said sheet, said fold lines thereby defining an even number of adjacent panels, said panels being hinged to each other along said fold lines common to adjacent panels, said fold lines being alternatingly formed in said sheet, wherein said sheet is folded along said fold lines to form the sheet into an accordion-like shape and to bring said panels into a superimposed substantially parallel relationship.

11. A ticket holder as recited in claim 1 wherein said ticket pocket includes a pressure sensitive adhesive to sealingly engage said front panel.

12. A ticket holder adapted to be worn by a patron comprising:

a generally transparent laminated sheet including top and bottom surfaces, said sheet having a first side with a dimension greater than a second side of said sheet, said sheet formed with a plurality of parallel fold lines, said fold lines perpendicular to said first side of said sheet, said fold lines thereby defining an even number of adjacent panels, including innermost and outermost panels, said panels being hinged to each other along said fold lines common to adjacent panels, said fold lines being alternatingly formed in said top and bottom surfaces, said sheet folded along said fold lines to form the sheet into an accordion-like shape and to bring said panels into a superimposed substantially parallel relationship; and an insert having printed information on at least one side, and said insert disposed between at least two of said panels in facing contact therewith, said insert fixed positionally by sealing at least a corresponding three edges of said outermost panels which do not include fold lines therewith.

13. A ticket holder as recited in claim 12 wherein said sheet is generally rectangular with a third side parallel to said first side, recessed edges formed in each of said first side and third side between said outermost panels.

14. A ticket holder as recited in claim 12 wherein said holder includes an aperture formed along a portion of said outer periphery.

15. A ticket holder as recited in claim 12, further comprising a generally hidden pocket located between said innermost and said outermost panels.

* * * * *